US008062819B2

(12) United States Patent
Yasukawa et al.

(10) Patent No.: US 8,062,819 B2
(45) Date of Patent: Nov. 22, 2011

(54) MAGENTA TONER FOR DEVELOPING ELECTROSTATIC IMAGE

(75) Inventors: Hiroyuki Yasukawa, Tokyo (JP); Mikio Kouyama, Tokyo (JP); Kenji Hayashi, Tokyo (JP); Hiroaki Obata, Tokyo (JP); Natsuko Kusaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 929 days.

(21) Appl. No.: 12/044,272

(22) Filed: Mar. 7, 2008

(65) Prior Publication Data

US 2008/0261141 A1 Oct. 23, 2008

(30) Foreign Application Priority Data

Apr. 17, 2007 (JP) ..... 2007-108189

(51) Int. Cl.
*G03G 9/09* (2006.01)

(52) U.S. Cl. ..... 430/108.21; 430/108.2; 430/108.11; 430/108.14

(58) Field of Classification Search ..... 430/108.2, 430/108.21
See application file for complete search history.

(56) References Cited

U.S. PATENT DOCUMENTS

| | | | | |
|---|---|---|---|---|
| 6,168,892 | B1 * | 1/2001 | Ohara et al. | 430/43.1 |
| 2005/0106481 | A1 * | 5/2005 | Ayaki et al. | 430/45 |
| 2006/0292481 | A1 | 12/2006 | Hayashi et al. | |
| 2007/0048643 | A1 * | 3/2007 | Kmiecik-Lawrynowicz et al. | 430/108.6 |
| 2007/0266890 | A1 * | 11/2007 | Taguchi et al. | 106/31.47 |
| 2008/0199615 | A1 * | 8/2008 | Harada et al. | 427/256 |

FOREIGN PATENT DOCUMENTS

| | | |
|---|---|---|
| EP | 0965890 | 12/1999 |
| JP | 03163566 | 7/1991 |
| JP | 2000181170 | 6/2000 |
| JP | 2006163300 | 6/2006 |
| JP | 2006323048 | 11/2006 |

OTHER PUBLICATIONS

English translation of of JP 2006163300 A, Jun. 2006, Yanagida, Kazuhiko.*
European Search Report No. EP 08 25 0870.

* cited by examiner

*Primary Examiner* — Mark F Huff
*Assistant Examiner* — Rashid Alam
(74) *Attorney, Agent, or Firm* — Lucas & Mercanti, LLP

(57) ABSTRACT

A magenta toner for developing an electrostatic image composed of a binder and a colorant is disclosed. The toner contains a tone controlling agent having a peak of fluorescent spectrum from 380 to 500 nm. An image excellent in light fastness and durability can be obtained and high color reproducibility with sufficient transparency and chromaticness can be realized by the magenta toner.

16 Claims, No Drawings

MAGENTA TONER FOR DEVELOPING ELECTROSTATIC IMAGE

This application claims the priority of Japanese patent application No. 2007-108189, filed Apr. 7, 2007, the entire content of which is hereby incorporated by reference.

TECHNICAL FIELD

This invention relates to a magenta atoner for developing an electrostatic image to be used in electrophotographic system.

TECHNICAL BACKGROUND

Recently, color image printing is spread in the field of copying machines and printer and demand for high image quality is raised on the market.

Color toners to be used in the copying machines and printers are required to have not only high color reproducibility but also high reliability, concretely stable electrostatic chargeability for stably for forming image density without dependency on humidity; cf. JA-A H05-019536.

All colors can be principally reproduced by color mixing of the subtractive primaries of yellow, magenta and cyan. However, in the case of practically forming a color image by color toners each containing an organic pigment, the reproducible gamut of color capable of being reproduced is limited sometimes according to the spectrographic properties of the organic pigment dispersed in a binder resin and the color mixing ability when the different color toners are overlapped. Therefore, the color of the original image tends to be difficultly reproduced in the practical use; cf. JP-A H09-166889.

Additive color synthesis using three color primaries of red, green and blue is principally advantageous for extending the reproducible color range, and the reproducible color range by the electrophotographic printer is left within the range of printing standard of Japan Color as against the color range standard s-BGR for displays for personal computers relating to internet. Therefore, a problem is caused that the color range of the display cannot reproduced by the printer; cf. JP-A 2005-196018.

Moreover, JP-A 2005-221891 discloses a toner containing a near-infrared radiation absorbent and a fluorescent whitening agent. However, the object of this toner is to form an invisible image not affecting a visible image and not to improve the color reproducibility in the visible image.

SUMMARY OF THE INVENTION

An object of the invention is to provide a magenta toner for developing an electrostatic image which has sufficient transparency and chromaticness so that high color reproducibility can be realized and the electrostatic charge on the toner is not lowered even under high humid condition. One aspect of the present invention is a magenta toner for developing an electrostatic image comprising magenta color particles containing a binder and a magenta colorant, wherein the magenta color particles contain a tone controlling agent having a peak of fluorescent spectrum within the range of from 380 to 500 nm.

DESCRIPTION OF THE INVENTION

As a result of the investigation by the inventors, it is found that the color gamut in the subtractive color system can be considerably extended by adding a specific tone controlling agent to magenta color particles so that high color reproducibility in blue and red region can be obtained. High color reproducibility in such the color range is difficultly obtained by usual full color electrophotographic image forming method. It is noted that the reproduction of red and blue colors is the weak point of the usual, magenta toner for electrophotography and the color range near that obtained by the additive color system can be obtained by the subtractive system by adding the tone controlling agent of the invention to the usual magenta toner. In the reflection spectrum of usual magenta colorant, the reflectivity at the region of from 380 to 500 nm is low so as to lower the color reproducibility. It is supposed that the effect of the invention is resulted by considerably raising the reflectivity in the region of from 380 to 500 nm by the fluorescence emitted by the specific tone controlling agent because the tone controlling agent is a substance capable of generating fluorescence. As above described, the magenta toner usually used in the electrophotographic system has reddish color or lowered reflectivity in the region of from 380 to 500 nm. Contrary to that, it is supposed that the high color reproducibility can be obtained by the magenta toner of the invention since the toner has good balance between red and blue.

Furthermore, it is also conjectured that the tone controlling agent of the invention provides ability to the toner to leak only excessive charge under low humidity condition and to maintain a certain electricity under high humidity condition since the tone controlling agent of the invention has high flatness of the molecular structure and is relatively rich in conjugative π-electron cloud.

The magenta toner for developing electrostatic image contains magenta color particles comprising a binder resin, a magenta colorant having a peak of fluorescent spectrum within the range of from 380 to 500 nm.

The toner controlling agent includes a compound represented by the following Formula 1, 2 or 3.

Formula 1

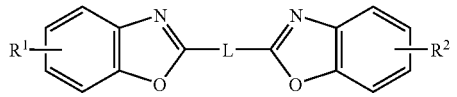

Formula 2

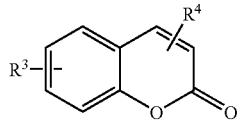

Formula 3

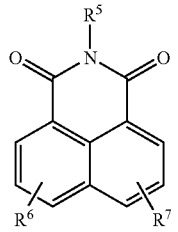

In the above, $R^1$ and $R^2$ are each a hydrogen atom or an alkyl group, $R^3$ is a hydrogen atom or a mono-valent substituent, $R^4$ is a hydrogen atom, an alkyl group, an alkoxy group or an aryl group, $R^5$ is a hydrogen atom or an alkyl group, $R^6$ and $R^7$ are each a hydrogen atom, an alkyl group, an alkoxy group or an acylamino group. L is a divalent group.

In the L*a*b* system of color representation, in which L* is brightness, a* is hue in the green-red direction and b* is hue in the yellow-blue direction, the hue angle of the magenta toner is preferably from 320° to 340° since the color reproducibility in the image formed on common paper can be improved in such the range of the hue angle.

The content of the tone controlling agent in the magenta color particles is preferably from 0.01 to 12% by weight, and particularly preferable from 1 to 8% by weight.

The magenta colorant is preferably a magenta oil soluble dye or a magenta metal chalet dye.

The particle diameter of the magenta color particles is preferably from 4 to 10 μm in volume-based median diameter.

By the magenta toner for developing electrostatic image of the invention, high light resistivity can be obtained since the toner contains the specific tone controlling agent fundamentally absorbing UV rays and high color reproducibility can be obtained since the agent generates fluorescence.

The magenta toner for developing electrostatic image is preferably prepared by fusing fine particles of binder resin and colorant fine particles. In such the case, the developing and transferring properties of the toner are stabilized and reproducibility of the adhering amount of the toner is made high and the scattering of variation of the hue angle is prevented. As above-mentioned, the magenta toner for developing electrostatic image of the invention has sufficient transparency and color reproducibility so that wide color reproducing gamut of magenta color can be obtained.

When the magenta toner of the invention is used for forming a full color image, high uniformity of charging ability of the toner particles can be obtained because the specific tone controlling agent containing in the magenta toner has charge controlling ability. Consequently, the charging amount of the magenta toner for developing electrostatic image can be agreed with that of another colored toner so that a visible image with high quality can be formed.

Moreover, images can be stably output for long period even when the toner is applied for an image forming apparatus using many optical sensors because the scattering of the toner is very small.

The invention will be described more in detail.

The magenta toner for developing electrostatic images, hereinafter also referred to as magenta toner, contains magenta color particles comprising a binder resin and a magenta colorant such as a magenta dye or a magenta pigment, and the magenta color particles contains at least one kind of the specific tone controlling agent.

The magenta toner is preferably an association type toner comprising magenta color particles formed by coagulating and fusing binder resin particles composed of binder resin containing a vinyl type polymer and colorant fine particles containing the magenta colorant such as the magenta dye or the magenta pigment.

In the L*a*b* system of color representation, in which L* is brightness, a* is hue in the green-red direction and b* is hue in the yellow-blue direction, the hue angle of the magenta toner at the toner adhering amount for forming the maximum chromaticness of the image formed on common paper is preferably from 320° to 340° and from 0° to 20° and more preferably from 320° to 340°.

The L*a*b* color representation system is useful means for representing color by numerical value, and L* represents the brightness in z-axis direction and a* and b* on x-axis and y-axis represent the hue and chromaticness. The brightness is relative brightness of color, the hue is tone of color such as red, yellow, blue and purple and the chromaticness is degree of vividness of color.

The hue angle is an angle of a line segment connecting a point of coordinates (a, b) and the origin of the coordinate axes O with a straight line extending to the plus-direction of x-axis in anticlockwise direction from the plus-direction of x-axis (red direction) on the plane of x-axis and y-axis representing the relation of the hue and the chromaticness when the brightness is a certain value. On the plane of x-axis and y-axis, the minus-direction of x-axis given by a* is direction of green and the plus-direction of y-axis given by b* is direction of yellow and the minus-direction of the y-axis is direction, of blue.

In the magenta color particles constituting the magenta toner, it is preferable that the colorant fine particles containing a magenta colorant are in a state of not dissolved in the binder resin. In concrete, the colorant fine particles are preferably one in which the magenta colored oil-soluble dye or metal chelate dye is dispersed in a coagulated state, for example.

When the colorant fine particles are in the state of not dissolved, namely the colorant fine particles maintain the solid state, exposing of the dye onto the surface of the magenta color particles is prevented so that bleeding of the dye can be prevented and high light fastness and heat resistivity can be given to the magenta dye.

In such the magenta toner, the volume-based median diameter of the colorant fine particles dispersed in the binder resin constituting the magenta toner is preferably within the range of from 10 to 500 nm, more preferably from 10 to 100 nm, and particularly preferably from 10 to 50 nm. When the volume-based median diameter is less than 10 nm, the stability of the colorant fine particles in the magenta toner is lowered and sufficient light fastness can e difficultly obtained because the surface area of the fine particles becomes very large. On the other hand, when the volume-based median diameter is larger than 500 nm, sufficient chromaticness per unit of dye is difficultly obtained and sufficient transparency of the visual image cannot be obtained sometimes by scattering of light.

The volume-based median diameter of the coloring fine article can be controlled by controlling the strength of the stress in stress-stirring, viscosity of a non-aqueous organic solvent solution, and addition of a suitable kind and amount of surfactant to an aqueous medium.

The magenta color particles constituting the magenta toner of the invention may be one having a core/shell structure which composed of a core containing the binder resin and the magenta colorant and a shell containing a resin covering the core and substantially no magenta colorant.

The core/shell structured magenta color particles is not only one in which the core particle is completely covered by the shell layer but also one in which the core particle is partially covered by the shell layer. Moreover, it may be one in which a part of the shell resin forms domains in the core particle. The shell layer may have multi-layer structure composed of two or more kinds of resin different from each other bin the composition thereof.

In the case of that the magenta color particle has such the core/shell structured particle, the specific tone controlling agent may be contained in one or both of the core particle and the shell layer, and particularly enhanced effects can be obtained when the agent is contained in the shell layer.

<The Specific Tone Controlling Agent>

The specific tone controlling agent is an organic fluorescent pigment represented by Formula 1, 2 or 3, and such the organic fluorescent pigment absorbs UV rays and emits fluorescence having a peak within the range of from 350 to 450 nm.

The specific tone controlling agent may be slightly colored but the tone controlling agent is preferably colorless or white under visible light in the state of contained in the toner so as to give no bad influence on the appearance such as the pattern and the color of the electrophotographic copied material. From such the viewpoint; it is preferable to use one having the peak of the fluorescence being within the range of from 350 to 400 nm, and particularly preferably within the range of from 350 to 380 nm.

The wavelength of the peak of the fluorescence of the specific tone controlling agent is measured in a state of dissolved in a solvent capable of dissolving the agent such as dimethylformamide by a spectrophotometer U-4000 manufactured by Hitachi Ltd.

The specific tone controlling agent of the invention represented by Formula 1 is a benzoxazole derivative and those represented by Formula 2 to 3 are each a coumarin derivative and a naphthalimide derivative, respectively.

As the specific tone controlling agent, the benzoxazole derivative is preferably used.

In Formula 1, $R^1$ and $R^2$ are each a hydrogen atom or an alkyl group; in Formula 2, $R^3$ is a hydrogen atom or a monovalent substituent and $R^4$ is a hydrogen atom, an alkyl group, an alkoxy group or an aryl group; and in Formula 3, $R^5$ is a hydrogen atom or an alkyl group and $R^6$ and $R^7$ are each a hydrogen atom, an alkyl group, an alkoxy group or an acylamino group. L is a divalent group.

Preferable example of L includes the following groups.

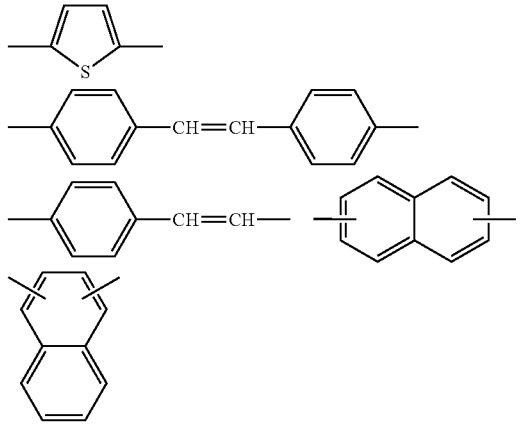

$R^3$ is preferably a mono-valent substituent containing a nitrogen atom-containing heterocyclic ring. Practical example of $R^3$ includes a substituent containing a monovalent triazine ring, triazole ring or pyrazole ring.

As the specific tone controlling agent of the invention of benzoxazole derivatives represented by Formula 1, compounds represented by Formula 1-A, 1-B, 1-C, 1-D or 1-E can be cited.

Formula 1-A

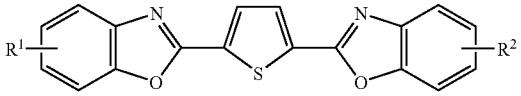

Formula 1-B

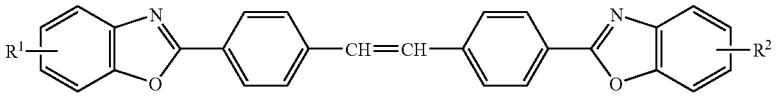

Formula 1-C

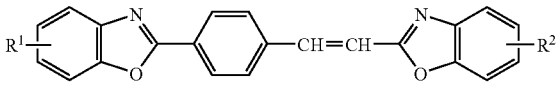

Formula 1-D

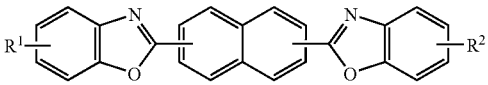

Formula 1-E

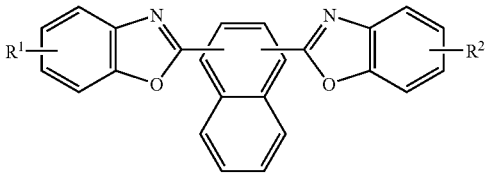

In Formulas, $R^1$ and $R^2$ are each a hydrogen atom or an alkyl group.

Examples of the compounds represented by Formula 1, 2 or 3 include compounds represented by the following Formula K-1 to K-15.

The content of the specific tone controlling agent is preferably from 0.01 to 12% and more preferably from 1 to 8%, by weight of the whole toner particles.

When the content of the specific tone controlling agent in the magenta toner is less than 0.01% by weight, the UV Formula K-1

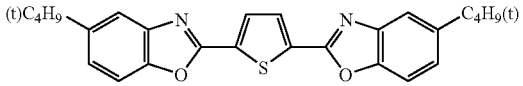

Formula K-2

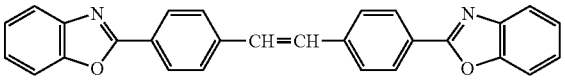

Formula K-3

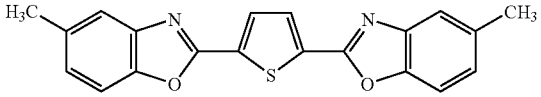

Formula K-4

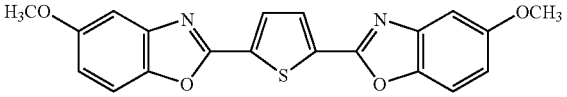

Formula K-5

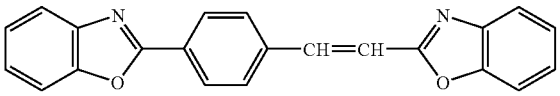

Formula K-6

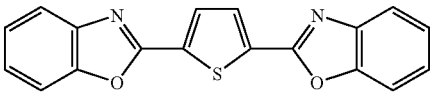

Formula K-7

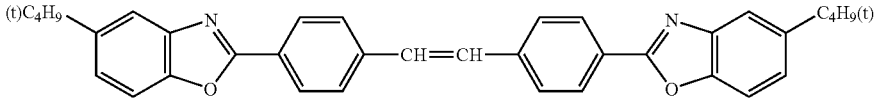

Formula K-8

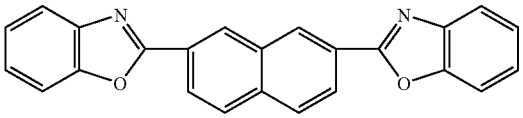

Formula K-9

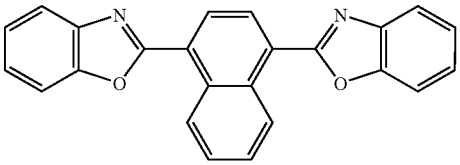

Formula K-10

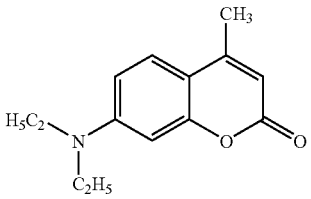

Formula K-11

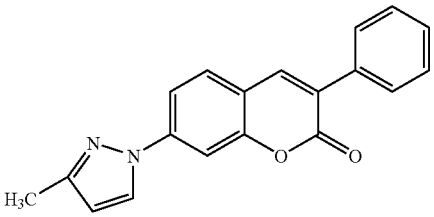

Formula K-12

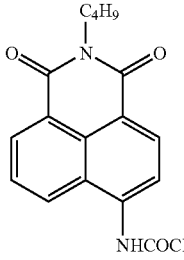

Formula K-13

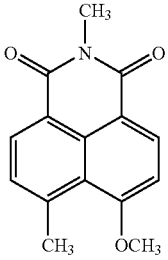

Formula K-14

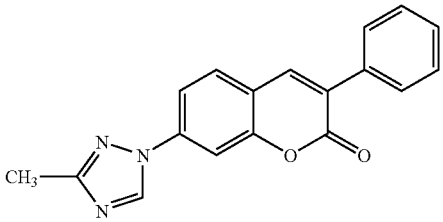

Formula K-15

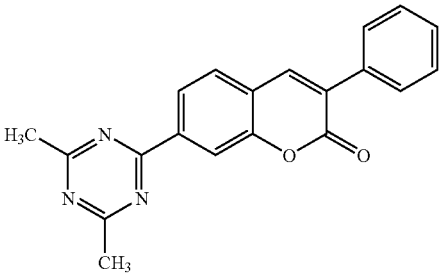

absorbing ability of the obtained toner is made low and sufficient light fastness cannot be obtained. On the other hand, when the content of the specific tone controlling agent is more than 12% by weight, the fixing ability of the obtained toner is made low and sufficient fluorescence emission is difficultly obtained since the concentration of the specific tone controlling agent in the toner is excessively raised and concentration quenching is resulted because energy transfer between the tone controlling agent molecules is made major compared to the fluorescence emission.

As the method for introducing the specific tone controlling agent into the magenta color particles, the following methods are applicable; a method in which the tone controlling agent is added in a state of dispersion of fine particles of mixture at molecular level of the magenta colorant and the tone controlling agent, a method in which the specific tone controlling agent is added in a state of individual dispersion separately prepared to the fine particle of the magenta colorant and that of the binder resin, and a method in which the tone controlling agent is added in a state of dispersion of fine particles of mixture at molecular level of the binder resin and the tone controlling agent. Among the above methods, the last method is preferable, because the specific tone controlling agent can be certainly arranged near the surface of the toner particle so as to certainly absorb UV rays.

<Magenta Colorant>

As the magenta colorant, usually known magenta dyes and magenta pigments are usable, and magenta colored oil-soluble dyes are preferable from the viewpoint of the color reproducibility and the transparency. Rhodamine compounds and magenta colored metal chelate dyes are particularly preferred.

The oil-soluble dye usable as the magenta colorant is usually dyes which have no water-soluble group such as a carboxylic acid group and a sulfonic acid group and is soluble in an organic solvent and insoluble in water. The dye includes water-soluble dyes obtaining oil solubility by forming a salt with a long chain amine such as acid dyes, direct dyes and reaction dyes each forming a dye with a long chain amine. In concrete, the oil-soluble dye is a dye having solubility in water of not more than 1% by weight and solubility in toluene of not less than 0.01 g/100 ml. The solubility of the dye in toluene can be measured by the following procedure; the dye is added to 100 ml of toluene at room temperature (25° C.) and stirred and stood for 24 hours, then the resultant solution is filtered and the weight of the dye contained in the solution is measured after removing toluene by distillation.

Concrete examples of such the magenta colored oil-soluble dye include C. I. Solvent Reds 3 (0.7), 14 (0.03), 17 (1.0), 18 (0.8), 22 (3.0), 23 (1.4), 49 (0.08), 51 (1.4), 53 (0.1), 87 (0.2), 127 (0.3), 128 (1.2), 131 (0.2), 15 (0.2), 146 (1.1), 149 (0.19), 150 (0.07), 152 (0.89), 153 (0.8), 154 (0.2), 155 (0.05), 156 (0.5), 157 (0.6), 158 (0.9), 176 (0.05) and 179 (0.37), and C. I. Solvent Oranges 49 (0.05), 63 (0.02), 68 (0.70), 71 (0.11), 72 (4.9) and 8 (0.33). A mixture of two or more of them is also usable.

The solubility in toluene of each of the above dyes is described in the parenthesis. The unit of the solubility is gram per 100 ml.

<Rhodamine Compound>

The rhodamine compounds are represented by the following Formula A-1 or A-2.

Formula A-1

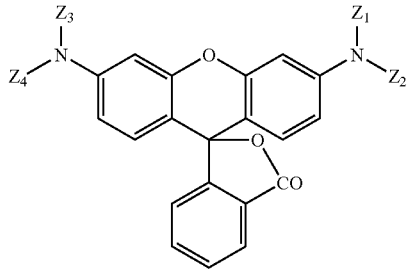

Formula A-2

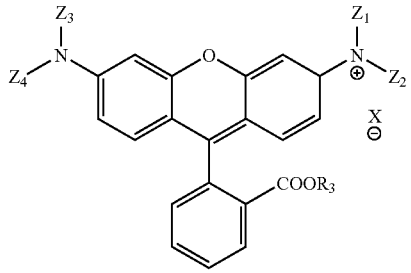

In the above, $Z_1$ to $Z_4$ are each a hydrogen atom or an alkyl group having 1 to 4 carbon atoms, preferably an alkyl group having 1 to 4 carbon atoms, and $R_3$ is an alkyl group having 1 to 6 carbon atoms. X is an anion.

Preferable compounds are Dyes 4 and 5.

Dye-4

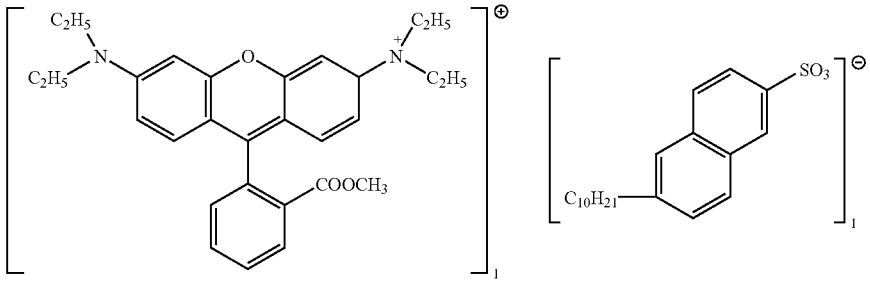

-continued

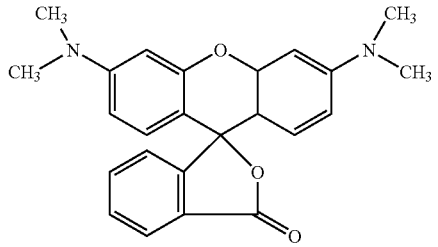

Dye-5

The chalet dye has high light absorbability. Therefore, sufficient transparency and chromaticness can be obtained and sufficient light fastness as the colorant can be also obtained by using the chelate dye as the magenta colorant.

The metal chelate dye to be used as the magenta dye is a compound in which di- ore more-dentate atom group of dye are coordinated with a melt ion, and a ligand other than the group of atoms of dye may be coordinated. The ligand is a group of atoms capable of coordinating with the metal ion and the group of atoms may have electric charge or not.

As concrete example of the metal chelate dye, compounds represented by the following Formula D can be cited.

$$M(Dye)_1(A)_m \qquad \text{Formula D}$$

In Formula D, M is a metal ion, Dye is a dye coordinated with the metal ion, 1 is an integer of 1 to 3 and m is an integer of 0 to 3. When m is 0, 1 is 2 or 3, the kind of dye may be the same or different.

As the metal ion represented by M, metals included in Groups I to VIII of the periodic table such as ions of Al, Co, Cr, Cu, Fe, Mn, Mo, Ni, Sn, Ti, Pt, Pd, Zr and Zn are exemplified. Ions of Ni, Cu, Cr, Co, Zn and Fe are preferable from the viewpoint of tone and various kinds of durability, and Cu and Ni are preferable from the viewpoint of tone and chromaticness, and Cu is further preferable.

As the chelate dye, dyes having Dye or an aromatic hydrocarbon ring or a heterocyclic ring each having a portion capable of di- or more-dentate coordinating with the metal ion and a chelating agent are preferable and metal chelate dyes such as those described in JP-A H09-277693, JP-A H10-20559 and JP-A H10-30061 are particularly preferable.

As the concrete examples of the magenta pigment, C. I. Pigment Reds 5, 48:1, 53:1, 57:1, 122, 139, 144, 149, 166, 177 and 222, and C. I Pigment Oranges 31 and 43 can be cited, and a mixture of them are also usable.

The above-described magenta colorants may be used singly or in a combination of two or more kinds of them.

As the binder resin, one containing a vinyl type polymer is preferable. Among such the binder resins, a thermoplastic resin is preferably used for obtaining sufficient contacting with the colorant fine particle and the use of a solvent-soluble resin is particularly preferred. A curable resin forming three dimensional structure is usable when the precursor of it is solvent-soluble.

Concrete examples of such the binder resin include a styrene type resin, an acryl type resin such as alkyl acrylate and alkyl methacrylate, a styrene-acryl type copolymer resin and olefin type resin. The styrene type resin and acryl type resin having high transparency, low viscosity in melted state and sharp melting property is suitable for improving the transparency and the color reproducibility of the piled image. These resins may be used singly or in combination of two or more kinds thereof.

A polyester resin, silicone resin, amide resin or epoxy resin may be used additionally to such the vinyl type resin.

As the monomer for obtaining the binder resin, for example, a styrene type monomer such as styrene, methylstyrene, methoxystyrene, butylstyrene, phenylstyrene and chlorostyrene, a (meth)acrylate type monomer such as methyl acrylate, ethyl acrylate, butyl acrylate, ethylhexyl acrylate, methyl methacrylate, ethyl methacrylate, butyl methacrylate and ethylhexyl methacrylate, and a carboxylic acid type monomer such as acrylic acid and fumaric acid are usable. These monomers may be used singly or in combination of two or more kinds of them.

Such the resins preferably have a number average molecular weight (Mn) of from 3,000 to 6,000 and more preferably from 3,500 to 5,000, a ratio Mw/Mn of weight average molecular weight (Mw) to number average molecular weight (Mn) is from 2 to 6 and more preferably from 2.5 to 5.5, a glass transition point (Tg) of from 50 to 70° C. and more preferably from 55 to 70° C., and a softening point of from 90 to 110° C. and more preferably from 90 to 105° C.

When the number average molecular weight of the binder resin is less than 3,000, the fixing ability against bending is lowered so that probability of causing an image fault by peeling the image is causes when the full color solid image is bended. When the number average molecular weight is more than 6,000, the thermally melting ability of the resin in the fixing process of the image formation is lowered and the fixing strength tends to be lowered. When the ratio of Mw/Mn is less than 2, high temperature offset is easily caused in the fixing process, and when the ratio Mw/Mn is more than 6, the sharp melt ability in the fixing process is lowered and the light transparency and the color mixing property of the obtained toner are not sufficiently obtained so that sufficient color reproducibility in the full color image cannot be obtained. When the glass transition point of the binder resin is less than 50° C., the heat resistivity of the obtained magenta toner cannot be made sufficiently and the toner tends to be coagulated during storage, and when the glass transition point is more than 70° C., the resultant magenta toner is difficultly melted and the fixing ability is lowered and sufficient color mixing ability cannot be obtained so that the sufficient color reproducibility in the resultant full color image cannot be obtained. When the softening point of the binder resin is less than 90° C., high temperature offset is easily caused in the fixing process, and when the softening point is more than 110° C., sufficient fixing strength, light transparency and color mixing ability cannot be obtained and the glossiness of the formed full color image is insufficient.

<Preparation Method of Magenta Toner>

As the method for producing the magenta toner of the invention, a method is preferred, in which the binder resin fine particles containing the vinyl type polymer and the colorant fine particles containing the magenta colorant are coagulated and fused, concretely an emulsion polymerizing coagulation method is cited.

The emulsion polymerizing coagulation method is a method in which a dispersion of fine particles composed of binder resin prepared by a emulsion polymerization, hereinafter referred to as the binder resin fine particle, is mixed with a dispersion of fine particles of another toner particle composing constituent such as the colorant fine particles and these particles are slowly coagulated while balancing the surface repulsion force of the fine particles according to pH value and the coagulating force caused by the addition of coagulating agent, and association of the particles is carried out while controlling the average particle diameter and the particle size distribution and the shape of the associated particle is simultaneously controlled by heating and stirring to produce the toner particles.

The binder resin fine particle may be one having two layers each respectively composed of resins different from each other. In such the case, such the binder resin particle can be prepared by a method in which a polymerization initiator and a monomer are added to a dispersion of the first resin prepared by an usual emulsion polymerization treatment (the first polymerization step) and the resultant system is subjected to a polymerization treatment (the second polymerization step).

An example of the process of the method for introducing the specific tone controlling agent into the magenta color particles, hereinafter referred to as Method (A), is concretely described below:

(i) A process for obtaining the colorant fine particle containing the specific tone controlling agent and the colorant, (ii) A hinder resin fine particle synthesizing process for obtaining the binder resin particles containing a parting agent and a charge controlling agent according to necessity, (iii) A process for forming the magenta color particles by salting out, coagulating and fusing the binder resin fine particles and the specific tone controlling agent-containing colorant fine particles in an aqueous medium, (iv) A filtration and washing process for filtering the magenta color particles from the magenta color particles dispersion (aqueous medium) and removing the surfactant from the magenta color particles, (v) A process for drying the washed magenta color particles, and (vi) A process for adding an external additive to the dried magenta color particles.

An example of the process of the method for introducing the specific tone controlling agent into the magenta color particles, hereinafter referred to as Method (B), is concretely described below:

(1) A process for obtaining coloring particles containing the magenta colorant, (2) A process for preparing fine particles of the specific tone controlling agent containing the specific tone controlling agent, (3) A binder resin synthesizing process for preparing binder resin fine particles containing a parting agent and a charge controlling agent according to necessity, (4) A process for forming magenta color particles by salting out, coagulating and fusing the binder resin particles, colorant fine particles and the specific tone controlling agent fine particles in an aqueous medium, (5) A filtration and washing process for filtering the magenta color particles from the magenta color particles dispersion (aqueous medium) and removing the surfactant from the magenta color particles, (6) A process for drying the washed magenta color particles, and (7) A process for adding an external additive to the dried magenta color particles.

An example of the process of the method for producing magenta color particles of the invention in which the specific tone controlling agent, hereinafter referred to as Method (C), is concretely described below:

(I) A specific tone controlling agent containing fine particles synthesizing process for forming specific tone controlling agent containing resin fine particles which contain the binder resin, the specific tone controlling agent, and a parting agent and a charge controlling agent according to necessity, (II) A process for obtaining colorant fine particles containing the magenta colorant, (III) A process for forming magenta color particles by salting out, coagulating and fusing the specific tone controlling agent-containing resin fine particles and the colorant fine particles in an aqueous medium, (IV) A filtration and washing process for filtering the magenta color particles from the magenta color particles dispersion (aqueous medium) and removing the surfactant from the magenta color particles, (V) A process for drying the washed magenta color particles, and (VI) A process for adding an external additive to the dried magenta color particles.

In the above, the "aqueous medium" is a medium composed of 50 to 100% by weight of water and 0 to 50% by weight of a water-soluble organic solvent. As the water-soluble organic solvent, methanol, ethanol, isopropanol, butanol, acetone, methyl ethyl ketone and tetrahydrofuran can be exemplified, an alcohol type organic solvent which cannot dissolve the obtained resin is preferable.

<Preparation Method of Colorant Fine Particle>

The colorant fine particle, in the case of the magenta colorant fine particles for example, can be obtained by an in-liquid drying method in which a dye containing solution prepared by dissolving or dispersing the magenta colorant in a water immiscible solvent such as ethyl acetate and toluene is emulsified in the aqueous medium by a dispersing machine and then the water immiscible solvent is removed to precipitate the colorant fine particles.

The emulsifying machine to be used in the in-liquid drying method is not specifically limited and an ultrasonic dispersing machine and a high speed stirring type dispersing machine are applicable, for example.

In the producing method of the magenta toner, the size of the binder resin fine particles coagulated in the salt out, coagulation and fusion process is preferably from 30 to 500 nm in volume-based median diameter, for example. The binder resin fine particle is the binder resin fine particle when the above Method (A) or (B) is applied and the specific tone controlling agent containing binder resin fine particle when Method (C) is applied.

[Surfactant]

In the in-liquid drying method, any surfactant such as usual cationic surfactants, anionic surfactants, amphoteric surfactants and nonionic surfactants can be used according to necessity, among them the anionic surfactants and the nonionic surfactants are preferably used and both type of the surfactant may be used in combination.

As the anionic surfactant, for example, a higher fatty acid salts such as sodium oleate; an alkylarylsulfonate such as sodium dodecylbenzenesulfonate; an alkylsulfate such as sodium laurylsulfate; a polyoxyethylene alkyl ether sulfate such as sodium polyoxyethoxyethylene lauryl ether sulfate; a polyoxyethylene alkylaryl ether sulfate such as sodium polyoxyethylene nonylphenyl ether sulfate; an alkylsulfosuccinate such as sodium monooctyl sulfosuccinate, sodium dioctylsulfosuccinate and polyoxyethylene laurylsulfosuccinate, and a derivative of them can be cited.

For example, dispersing agent Demol SNB, MS, N, SSL, ST and P, each manufactured by Kao Corps, are usable.

As the polymer surfactant, water-soluble resins such as a styrene-acrylic acid-alkyl acrylate copolymer, styrene-acrylic acid copolymer, styrene-maleic acid-alkyl acrylate copolymer, styrene-maleic acid copolymer, styrene-methacrylic acid-alkyl acrylate copolymer, styrene-methacrylic acid copolymer, styrene-maleic half ester copolymer, vinylnaphthalene-acrylic acid copolymer and styrene-maleic acid copolymer can be cited. Other than those, acryl-styrene type resin JONCRYL, marketed by Johnson Polymer, is usable.

As the nonionic surfactant, a polyoxyethylene alkyl ether such as polyoxyethylene lauryl ether and polyoxyethylene stearyl ether; a polyoxyethylene alkylphenyl ether such as polyoxyethylene nonylphenyl ether; a sorbitan higher fatty acid ester such as sorbitan monolaurate, sorbitan monostearate and sorbitan trioleate; a polyoxyethylenesorbitan higher fatty acid ester such as polyoxyethylenesorbitan monolaurate; a polyoxyethylene higher fatty acid ester such as polyoxyethylene monolaurate and polyethylene monostearate; a glycerol higher fatty acid ester such as oleic monoglyceride and stearic monoglyceride; and polyoxyethylene-polyoxypropylene block copolymer can be cited.

As the amphoteric surfactant, a carboxybetaine type, sulfobetaine type, and an aminocarboxylic acid type surfactant and imidazoliniumbetaine are cited.

As the cationic surfactant, an aliphatic amine salt, an aliphatic quaternary ammonium salt, a benzalkonium salt a benzethonium chloride, a pyridinium salt and an imidazolium salt are cited.

The above surfactants can be used solely or in combination of two or more kinds of them according to necessity. The adding amount of the surfactant is preferably from 0.001 to 1.0% by weight of the coloring particles.

[Chain-Transfer Agent]

When the magenta color particles are produced by the emulsion polymerizing coagulation method, a usual chain-transfer agent can be used for controlling the molecular weight of the binder resin. As the chain-transfer agent, a mercaptan such as 2-chloroethanol, octylmercaptan, dodecylmercaptane and t-dodecylmercaptane, and α-methylenestyrene dimer can be cited.

[Polymerization Initiator]

When the magenta color particles are prepared by the suspension polymerization method, emulsion polymerization method or emulsion polymerizing coagulation method, an optional water-soluble polymerization initiator can be used as the polymerization initiator for obtaining the binder resin. Concrete examples of the polymerization initiator include a persulfate such as potassium persulfate and ammonium persulfate, an azo type compound such as 4,4'-azobis-4-cyanovaleric acid and its salt and 2,2'-azobis(2-amidinopropane salt, and a peroxide compound.

[Surfactant]

Various ionic surfactants and nonionic surfactants are usable as the surfactant to be used when the magenta color particles are prepared by the suspension polymerization method, emulsion polymerization method or emulsion polymerizing coagulation method.

[Coagulation Agent]

As the coagulation agent to be used when the magenta color particles are prepared by the emulsion polymerizing coagulation method, an alkaline metal salt and an alkaline earth metal salt are usable. Lithium, potassium and sodium are cited as the alkaline metal constituting the coagulation agent, and magnesium, calcium, strontium and barium are cited as the alkaline earth metal constituting the coagulation agent. Among them, potassium, sodium, magnesium, calcium and barium are preferable. As the counter ion (cation constituting the salt) of the alkaline metal and the alkaline earth metal, chloride ion, bromide ion, iodide ion, carbonate ion and sulfate ion are applicable.

[Parting Agent]

The magenta color particles may contain a parting agent contributing to prevent offset. Examples of the parting agent include polyethylene wax, oxide type polyethylene wax, polypropylene wax, oxide type polypropylene wax, carnauba wax, SAZOL wax, rice wax, Candelilla wax, jojoba oil wax and bees wax.

A method in which a dispersion of the parting agent (wax emulsion) is added at the salt out, coagulation and fusion process and the binder resin fine particles, colorant fine particles and the parting agent particles are salted out, coagulated and fused and a method in which the binder resin fine particle containing the parting agent and the colorant fine particles are salted out, coagulated and fused in the salt out, coagulation and fusion process for forming the magenta color particles, are applicable as the method for adding the parting agent into the magenta color particles. A combination of these methods may be applied.

The content of the parting agent in the magenta color particles is usually from 0.5 to 25 parts and preferably from 4 to 15 parts, by weight to 100 parts by weight of the binder resin. Unit-offset ability can be obtained while holding suitable fixing ability and the glossiness of the fixed image can be set with high freedom degree when the content of the parting agent is within such the range.

<Particle Diameter of Magenta Color Particles>

The diameter of the magenta color particles is preferably from 4 to 10 nm, and more preferably from 6 to 9 nm, in volume-based median diameter, for example. The particle diameter can be controlled by timing of addition of the coagulation agent (salt out agent) and the coagulation stopping agent, temperature at the coagulation and the composition of the polymer.

The transfer efficiency of the toner is raised and the quality of halftone image, fine line and dot image is improved when the volume-based median diameter is within the above range.

The volume-based median diameter of the magenta color particles is measured and calculated by a measuring apparatus composed of Coulter Multisizer TA-III connected with a data processing computer system, each manufactured by Beckman-Coulter Inc. In concrete, the measurement is carried out by the follows procedure; 0.02 g of the toner is added and wetted into 20 ml of a surfactant solution for dispersing the toner, for example, a solution prepared by diluting by 10 times a neutral detergent, and dispersed for 1 minute by an ultrasonic disperser to prepare a magenta toner dispersion, and the toner dispersion is injected by a pipette to a beaker containing ISOTON II, manufactured by Beckman Coulter Inc., set on a sample stand until the density indicated on the measuring apparatus becomes 59% to 10%. The particle diameters of 25,000 particles are measured using an aperture of 50 μm and frequency of the particle diameter was calculated by dividing the measuring range of from 1 to 30 μm into 256 divisions, and the particle diameter at 50% from the larger side of the cumulative volume percent is defined as the volume-based median diameter.

<External Additive>

The magenta toner may be prepared by adding a fluidizing agent and a cleaning aid s so called as post-treating agent to the magenta color particles for improving the fluid ability, charging property and cleaning suitability, although the magenta color particles may be used as a magenta toner without any treatment.

As the post-treating agent, for example, an inorganic oxide fine particle such as fine particle of silica, alumina and titanium oxide; a fine particle of metal stearate such as fine particle of aluminum stearate and zinc stearate; and a fine particle of inorganic titanate such as a fine particle of strontium titanate and zinc titanate are cited. These particles may be used singly or in combination of two or more kinds thereof.

These inorganic particles are preferably treated on the surface thereof by a silane coupling agent, a titanium coupling agent, a higher fatty acid or silicone oil for improvement in the storage ability against heating and the stability against environmental condition.

The adding amount of such the external additives is from 0.05 to 5, and preferably from 0.1 to 3, parts by weight in total to 100 parts by weight of the magenta toner. The various combinations of the external additives may be applied.

[Developer]

The magenta toner of the invention may be used not only as a magnetic or non-magnetic one-component developer but also a two-component developer by mixing with a carrier. When the magenta toner of the invention is used as the two-component developer, a magnetic particle composed of a metal such as iron, ferrite and magnetite and an alloy composed of such the metal and aluminum or lead can be used as the carrier, and the ferrite particle is particularly preferable.

A coated carrier composed of the magnetic particle coated with a coating material such as a resin and a binder type carrier composed of binder resin in which the magnetic particles are dispersed may also be used as the carrier.

As the coating resin constituting the coated carrier, for example, an olefin type resin, styrene type resin, styrene-acryl type resin, silicone type resin, ester type resin and fluororesin are cite though the resin is not specifically limited. As the resin constituting the resin dispersion type carrier, for example, a styrene-acryl type resin, polyester resin, fluororesin and phenol resin are usable.

The volume-based median diameter of the carrier is preferably from 20 to 100 μm and more preferably from 20 to 60 μm. The volume-based median diameter of the carrier can be typically determined by a laser diffraction particle size distribution measuring apparatus having a wet type disperser HEROS, manufactured by Sympatec GmbH.

High light fastness and high chromaticness can be obtained by such the magenta toner since the toner contains the specific tone controlling agent which fundamentally has UV absorbing ability. Moreover, high transparency can be obtained and variation in the hue angle caused by variation of the adhering amount of the toner can be inhibited because the magenta toner is constituted by coagulating and fusing the binder resin fine particles and the colorant fine particles so that any concealing particle is not existence. As above-mentioned, the magenta toner for developing electrostatic image has sufficient transparency and chromaticness so that magenta color with high color reproducibility can be obtained.

When the toner is used for forming full color images, the charging amount of the magenta toner for developing electrostatic image can be easily adjusted to that of the other colored, toners. Consequently, high quality visible images can be formed.

Furthermore, scattering of the toner on the occasion of the image formation can be made extremely small.

An effect to stabilize the charge of the toner is caused between the specific tone controlling agent and the magenta colorant in the magenta toner composed of the toner particles in which the specific tone controlling agent is contained in the colorant fine particle. Accordingly, in magenta toners using a usual magenta dye, problems of lowering in the charging amount, high dependency on the environmental condition such as that the difference between the charging amount under high temperature and high humidity condition and the under low temperature and low humidity condition is large, and disagreement in the charging amount between the each colored toners, for example, cyan, magenta, yellow and black toners, are not caused. Consequently, excellent image properties can be obtained because the charging property of each of the magenta color particles in the magenta toner is substantially made uniform.

EXAMPLES

Concrete examples of the invention are described bellow.

Preparation Example 1 of Colorant Fine Particle

In 450 g of ethyl acetate, 20 g of the magenta dye D-1 shown by the following Formula D-1 was dissolved and then the solution was dropped into 750 g of an n aqueous solution containing 8 g of AQUALON KH-05, manufactured by Daiichi Kogyo Seiyaku Co., Ltd., and stirred. After that the resultant mixture was subjected to emulsifying treatment for 300 seconds by CLEARMIX W motion CLM-0.8 W, manufactured by MTECH Co., Ltd., and then ethyl acetate was removed under reduced pressure to obtain a colorant fine particle dispersion 1 containing colorant fine particles 1 having a volume-based median diameter of 47 nm.

The volume-based median diameter was measured by NANOTRAC UPA-EX150, manufactured by Nikkiso Co., Ltd.

Formula D-1

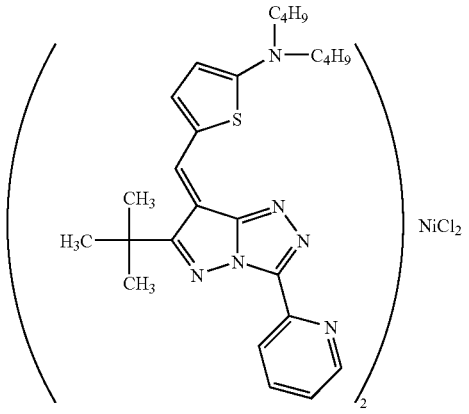

Preparation Example 2 of Colorant Fine Particle Dispersion

Colorant fine particle dispersion 2 containing coloring particles dispersion 2 having a median diameter of 51 nm was prepared in the same manner as in the preparation example of colorant fine particle dispersion 1 except that the magenta dye D-2 representing by the following Formula D-2 was used in place of the Magenta dye D-1.

Formula D-2

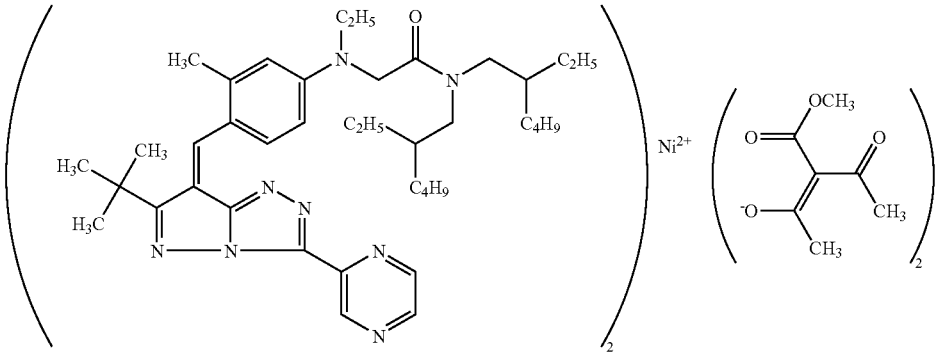

Preparation Example 3 of Colorant Fine Particle Dispersion

Colorant fine particle dispersion 3 containing coloring particles dispersion 3 having a median diameter of 28 nm was prepared in the same manner as in the preparation example 1 of colorant fine particle dispersion except that the magenta dye D-3 represented by the following Formula D-3 was used in place of the magenta dye D-1.

Formula D-3

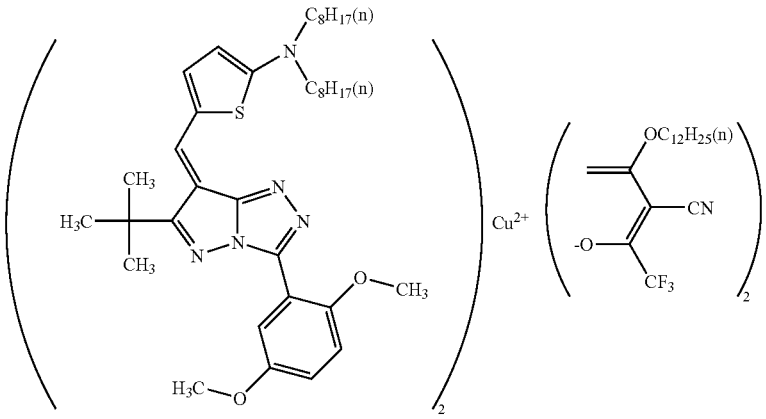

Preparation Example 4 of Colorant Fine Particle Dispersion

Colorant fine particle dispersion 4 was prepared in the same manner as in preparation example of colorant fine particle 1 except that the magenta dye D-1 was replaced by the same amount of Dye 5.

Preparation Example 5 of Colorant Fine Particle Dispersion

In 160 g of deionized water, 9.2 g of sodium dodecylsulfate was dissolved by stirring and 20 g of quinacridone type magenta pigment C. I. Pigment Red 48 was gradually added as the magenta colorant while continuously stirring, and then the mixture was subjected to dispersing treatment by a mechanical disperser CLEARMIX, manufactured by MTECH Co., Ltd., to prepare colorant fine particle dispersion 5 in which colorant particles were dispersed. The particle diameter of the colorant particle in the colorant fine particle dispersions 5 measured by an electrophoretic light scattering photometer ELS-800, manufactured by Otsuka Electronics Co., Ltd., was 120 nm in volume-based median diameter.

Preparation Examples 6 to 8 of Colorant Fine Particle Dispersions

Colorant fine particle dispersions 6 to 8 were prepared in the same manner as in the above except that C. I. Pigment Red 48 was replaced by the same manner of C. I. Pigment Red 81, C. I. Pigment Red 122 and C. I. Pigment Red 185, respectively. The particle diameter of the colorant particle in each of the colorant fine particle dispersions 6 to 8 measured by an electrophoretic light scattering photometer ELS-800, manufactured by Otsuka Electronics Co., Ltd., were within the range of 107 to 124 nm in volume-based median diameter.

Preparation Example of Fine Particle Dispersion of the Specific Tone Controlling Agent A solution of the specific tone controlling agent was prepared by dissolving 20 g of specific tone controlling agent K-1 represented by Formula K-1 in 450 g of ethyl acetate. The solution was dropped into 750 g of an aqueous solution containing 8 g of a surfactant AQUALON KH-05, manufactured by Daiichi Kogyo Seiyaku Co., Ltd., while stirring, and then emulsified for 300 seconds by CLEARMIX W motion CLM- 0.8 W. After that, ethyl acetate was removed under reduced pressure to obtain specific tone controlling agent fine particle dispersion 1 containing specific tone controlling agent fine particle 1 having a volume-based median diameter of 35 nm.

Preparation Example 1 of Resin Particle Dispersion

A surfactant solution (aqueous medium) prepared by dissolving 7.08 g of an anionic surfactant (sodium dodecylbenzenesulfonate) in 2760 g of deionized water was previously charged into a 500 ml separable flask on which a stirrer, temperature sensor, cooling tube and nitrogen gas introducing device were attached and the interior temperature of the flask was raided by 80° C. while stirring at a speed of 230 rpm under nitrogen gas stream. On the other hand, the first monomer solution composed of 72.0 g of the compound represented by the following Formula W as the parting agent, 115.1 g of styrene, 2.0 g of n-butyl acrylate and 10.9 g of methacrylic acid was prepared. The first monomer solution (80° C.) was dispersed in the above surfactant solution (80° C.) by a mechanical disperser having a circulation pass to prepare a dispersion of emulsified particles (oil droplets) having uniform diameter. Then an initiator solution composed of 200 g of deionized water and 0.84 g of a polymerization initiator (potassium persulfate: KPS) was added to the above emulsified dispersion and the system was heated and stirred for 3 hours at 80° C. for carrying out polymerization (the first step of polymerization) to prepare a latex.

After that, a solution prepared by dissolving 8.00 g of the polymerization initiator (KPS) and 10.0 g of 2-chloroethanol as a water-soluble chain-transfer agent in 240 g of deionized water was added to the above obtained latex. After passing 15 minutes, the second monomer solution composed of 383.6 g of styrene, 140.0 g of n-butyl acrylate and 36.4 g of methacrylic acid was dropped to the latex spending 126 minutes. After completion of the dropping, polymerization (the second step of polymerization) was carried out by heating and stirring for 60 minutes and then cooled by 40° C. to prepare resin particle dispersion LX-1 containing resin fine particles 1.

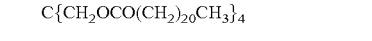

$C\{CH_2OCO(CH_2)_{20}CH_3\}_4$ Formula W

Preparation Example 2 of Resin Particle Dispersion

A surfactant solution (aqueous medium) prepared by dissolving 7.08 g of an anionic surfactant (sodium dodecylbenzenesulfonate) in 2760 g of deionized water was previously charged into a 500 ml separable flask on which a stirrer, temperature sensor, cooling tube and nitrogen gas introducing device were attached and the interior temperature of the flask was raided by 80° C. while stirring at a speed of 230 rpm under nitrogen stream. On the other hand, the first monomer solution composed of 72.0 g of the compound represented by the above Formula W as the parting agent, 115.1 g of styrene, 2.0 g of n-butyl acrylate and 10.9 g of methacrylic acid was prepared. On the other hand, the first monomer solution composed of 130.5 of styrene, 47.4 g of n-butyl acrylate, 15.5 g of methacrylic acid and specific tone controlling agent K-1 represented by the foregoing Formula K-1 was prepared by heating by 80° C. The first monomer solution (80° C.) was dispersed in the above surfactant solution (80° C.) by a mechanical disperser having a circulation pass to prepare a dispersion of emulsified particles (oil droplets) having uniform diameter. Then an initiator solution composed of 200 g of deionized water and 0.82 g of a polymerization initiator (potassium persulfate: KPS) was added to the above emulsified dispersion and the system was heated and stirred for 3 hours at 80° C. for carrying out polymerization (the first step of polymerization) to prepare a latex.

After that, a solution prepared by dissolving 7.84 g of the polymerization initiator (KPS) and 9.8 g of 2-chloroethanol as a water-soluble chain-transfer agent in 240 g of deionized water was added to the above obtained latex. After passing 15 minutes, the second monomer solution composed of 331.6 g of styrene, 120.4 g of n-butyl acrylate and 39.3 g of methacrylic acid was dropped to the latex spending 120 minutes. After completion of the dropping, polymerization (the second step of polymerization) was carried out by heating and stirring for 60 minutes and then cooled by 40° C. to prepare resin particle dispersion LX-2 containing resin fine particles 2.

Preparation Example 3 of Resin Particle Dispersion

Resin particle dispersion LX-3 containing resin particles 3 was prepared in the same manner as in preparation example 2 of resin particle dispersion except that specific tone controlling agent K-2 was used in place of the compound represented by Formula K-1.

Preparation Example 1 of Comparative Magenta Toner

To a 5 liter four-mouthed flask on which a thermo-sensor, cooler, nitrogen introducing device and stirrer, 1250 g of resin particle dispersion LX-1, 2,000 g of deionized water and 165 g of colorant fine particle dispersion 7 were charged and stirred to prepare a solution for association The internal temperature of the solution for association was controlled at 30° C. and pH was adjusted to 10.0 by adding a 5 mole/L sodium hydroxide aqueous solution. After that, an aqueous solution prepared by dissolving 52.6 g of magnesium chloride hexahydrate in 72 g of deionized water was added spending 10 minutes at 30° C. while stirring. After standing for 3 minutes, temperature was raised by 90° C. spending 6 minutes at a raising rate of 10° C./min. In such the situation, the size of the associated particle was measured by Coulter Counter TA-III, manufactured by Coulter Inc., and an aqueous solution composed of 115 g of sodium chloride and 700 g of deionized water was added to stop particle growing at the time when the volume-based median diameter become 6.5 μm, and then fusion of the particles was continued by continuing heating and stirring for 6 hours at a liquid temperature of 90° C.±2° C. After that, the system was cooled by 30° C. at a cooling rate of 6° C./minute and pH was adjusted to 2.0 by adding hydrochloric acid and then stirring was stopped. Thus formed associated particles were separated from the liquid and washed for 4 times by 15 liter of deionized water and dried by warm wing of 40° C. to obtain comparative magenta toner mother particles 1.

External Additive Treatment

To the comparative toner mother particles 1, 1% by weight of hydrophobic silica (number average primary particle diameter: 12 nm, hydrophobicity: 68) and 1% by weight of hydrophobic titanium oxide (number average primary particle diameter: 20 nm, hydrophobicity: 63) were added and mixed by Henschel mixer, manufactured by Mitsui Miike Kakoki Co., Ltd. Coarse particles were eliminated by a sieve having a opening size of 45 μm. Thus comparative magenta toner 1 composed of the comparative magenta color particles 1.

The shape and diameter of the comparative magenta toner mother particle were not varied by the addition of the hydrophobic silica.

Preparation Examples 2 to 4 of Comparative Magenta Toner

Comparative magenta toner mother particles 2 to 4 were prepared in the same manner as in the preparation example 1 of the comparative magenta toner except that the colorant fine particle dispersion 7 was replaced by the colorant fine particle dispersions 1, 2 and 8, respectively, and comparative magenta toners 2 to 4 composed of comparative magenta color particles 2 to 4 were prepared by subjecting the external additive treatment in the same manner as in the preparation example 1 of the comparative magenta toner.

Preparation Example 1 of Magenta Toner

Into a 5 liter four-mouthed flask on which a thermo-sensor, cooler, nitrogen introducing device and stirrer, 1250 g of resin particle dispersion LX-1, 1,940 g of deionized water, 165 g of colorant fine particle dispersion 4 and 60 g of the specific tone controlling agent fine particle dispersion 1 were charged and stirred to prepare a solution for association. The internal temperature of the solution for association was controlled at 30° C. and pH was adjusted to 10.0 by adding a 5 mole/L sodium hydroxide aqueous solution. After that, an aqueous solution prepared by dissolving 52.6 g of magnesium chloride hexahydrate in 72 g of deionized water was added spending 10 minutes at 30° C. while stirring. After standing for 3 minutes, temperature was raised by 90° C. spending 6 minutes at a raising rate of 10° C./min. In such the situation, the size of the associated particle was measured by Coulter Counter TA-III, manufactured by Coulter Inc., and an aqueous solution composed of 115 g of sodium chloride and 700 g of deionized water was added to stop particle growing at the time when the volume-based median diameter become 6.5 μm, and then fusion of the particles was continued by continuing heating and stirring for 6 hours at a liquid temperature of 90° C.±2° C. After that, the system was cooled by 30° C. at a cooling rate of 6° C./minute and pH was adjusted to 2.0 by adding hydrochloric acid and then stirring was stopped. Thus formed associated particles were separated from the liquid and washed for 4 times by 15 liter of deionized water and dried by warm wing of 40° C. to obtain magenta toner mother particles 1. Thus obtained magenta toner mother particles 1 were subjected to the same external additive treatment as in the preparation example 1 of comparative magenta toner to prepare magenta toner 1 composed of the magenta color particles 1.

Preparation Examples 2 to 20 of Magenta Toner

Magenta toners 2 to 20 were prepared in the same manner as in the preparation example 1 of magenta toner except that 165 g of the colorant fine particle dispersion 4 and 60 g of the specific tone controlling agent fine particle dispersion 1 were each replaced by the same amount of colorant fine particle dispersion and that the compound K-1 used in the tone controlling agent fine particle dispersion was changed to the same amount of the compound described in Table 1.

Preparation Example 21 of Magenta Toner

Into a 5 liter four-mouthed flask on which a thermo-sensor, cooler, nitrogen introducing device and stirrer, 875 g of resin particle dispersion LX-1, 2,000 g of deionized water and 165 g of colorant fine particle dispersion 3 were charged and stirred to prepare a solution for association. The internal temperature of the solution for association was controlled at 30° C. and pH was adjusted to 10.0 by adding a 5 mole/L sodium hydroxide aqueous solution. After that, an aqueous solution, prepared by dissolving 52.6 g of magnesium chloride hexahydrate in 72 g of deionized water was added spending 10 minutes at 30° C. while stirring. After standing for 3 minutes, temperature was raised by 90° C. spending 6 minutes at a raising rate of 10° C./min. In such the situation, the particle diameter was measured by Coulter Counter AT-III, manufactured by Coulter Inc., and the mother particles were held until the volume-based median diameter become 6.5 μm. Then 97 g of resin particle dispersion LX-2 was gradually added to the above obtained mother particle dispersion spending 10 minutes. The system was stood until the supernatant liquid of the centrifuged sample was made clear for fixing the resin particles 2 on the surface of each the mother particles. After that, an aqueous solution composed of 115 g of sodium chloride and 700 g of deionized water was added to stop particle growing, and then fusion of the particles was continued by continuing heating and stirring for 6 hours at a liquid temperature of 90° C.±2° C. Then the system was cooled by 30° C. at a cooling rate of 6° C./minute and pH was adjusted to 2.0 by adding hydrochloric acid and then stirring was stopped. Thus formed associated particles were separated from the liquid and washed for 4 times by 15 liter of deionized water and dried by warm wing of 40° C. to obtain magenta toner mother particles 6. Thus obtained magenta toner mother particles 6 were subjected to the same external additive treatment as in the preparation example 1 of comparative magenta toner to prepare magenta toner 21 composed of the magenta color particles 21.

Preparation Example 22 of Magenta Toner

Magenta toner mother particles were prepared in the same manner as in the preparation example 21 except that the colorant fine particle dispersion 3 and the resin particle dispersion LX-2 were each replaced by the colorant fine particle dispersion 1 and the resin particle dispersion LX-3, respectively, and the obtained toner mother particles were subjected to the external additive treatment in the same manner as in the preparation example 1 to prepare magenta toner 22 composed of magenta color particles 22.

Preparation Example 23 of Magenta Toner

Magenta toner mother particles were prepared in the same manner as in the preparation example 21 except that the resin particle dispersion LX-2 was replaced the resin particle dispersion LX-3, and the obtained toner mother particles were subjected to the external additive treatment in the same manner as in the preparation example 1 to prepare magenta toner 23 composed of magenta color particles 23.

Preparation Example 24 of Magenta Toner

Magenta toner mother particle 24 was prepared in the same manner as in the preparation example 1 except that the colorant fine particle dispersion 8 and the resin particle dispersion LX-1 were each replaced by the colorant fine particle dispersion 1 and the resin particle dispersion LX-2, respectively, and the specific tone controlling agent fine particle dispersion 1 was used, and the magenta toner mother particle 24 was subjected to the external additive treatment in the same manner as in the preparation example 1 to prepare magenta toner 24 composed of magenta color particles 24.

Preparation of Developer

Two-component developers 1 to 24 and comparative developers 1 to 4 were prepared by mixing a ferrite carrier having a volume-based median diameter with each of the magenta toners 1 to 24 and the comparative magenta toners 1 to 4, respectively.

Examples 1 to 24, Comparative Examples 1 to 4

The developers 1 to 14 and the comparative developers 1 to 4 were subjected to the following practical evaluations 1 to 5 by using bizhab C 250, manufactured by Konica Minolta Business Technologies Inc. Results of the evaluation are listed in Table 1. In the tests, Yellow toner, Yellow Developer, Cyan toner and Cyan Developer for bizhab C 250, manufactured by Konica Minolta Business Technologies Inc., were used as the yellow toner, yellow developer, cyan toner and cyan developer.

(1) Sensual Evaluation of Bluish Image

For evaluating color reproducibility of light blue and dark blue images, logo-marks of 50 companies each using sky blue or blue colored logo-mark were displayed on the computer display described as follows and printed on copying paper Washi Copy Daio, manufactured by Ozu Corp., and the printed image was evaluated by the number of panelist who evaluated the image as that "the image displayed on the display was reproduced on the copying paper without sense of incompatibility" among randomly selected 100 panelists within a age bracket range of 10 to 70.

Evaluation Norm

A: Number of persons who evaluated the image as that "the image was reproduced" was not less than 90: Excellent B: Number of persons who evaluated the image as that "the image was reproduced" was not less than 80 and less than 90: Good C: Number of persons who evaluated the image as that "the image was reproduced" was not less than 60 and less than 80: Practically usable D: Number of persons who evaluated the image as that "the image was reproduced" was less than 60: Not good

[Computer]

IMAC (Apple Computer Inc.)
24 inch wide screen LCD
Resolution of 1,920×1,200 pixels
2. 16
HZ INTEL CORE 2 DUO Processor 1
4 MB common L2 cash
1 GB memory
250 GB serial ATA hard disk drive
8× double layer Superdrive (DVD+R DL, DVD±RW, CD-RW)
NIVIDIA GEFORCE 7300 GT 128 MB GDDR3 memory
Air Mac Extreme and built-in Blue tooth 2.0
Apple remote (2) Sensual Evaluation of Reddish Image Logo-marks of 50 companies each using Reddish colored logo-mark were displayed on the computer display described as follows and printed on copying paper Washi Copy Daio, manufactured by Ozu Corp., and the printed image was evaluated by the number of panelist who evaluated the image as that "the image displayed on the display was reproduced on the copying paper without sense of incompatibility" among randomly selected 100 panelists within a age bracket range of 10 to 70.

Evaluation Norm

A: Number of persons who evaluated the image as that "the image was reproduced" was not less than 90. Excellent B: Number of persons who evaluated the image as that "the image was reproduced" was not less than 80 and less than 90: Good C: Number of persons who evaluated the image as that "the image was reproduced" was not less than 60 and less than 80: Practically usable D: Number of persons who evaluated the image as that "the image was reproduced" was less than 60: Not good The same computer used for the sensual evaluation of bluish image was used for the evaluation.

(3) Color Difference

The evaluation of the color gamut can be represented by the occupied area of a*b* in L*a*b* measurement of six colors of Y, M, C, R, G and B in a color chart, and it can be judged that the color reproducing range is extended when the occupied area is made larger. The measurement was carried out by using Macbeth Color Eye 7000 with a light source of ASTM-D65 at a observation field of 2° and SEC mode. The evaluation was carried out according to the ratio of the area of color gamut to s-RCB standard set at 1.00, and the ratio of not less than 1.1 was judged as acceptable level.

A: Color gamut area ratio was not less than 0.9.

B: Color gamut area ratio was not less than 0.7 and less than 9.0.

C: Color gamut area ratio was not less than 0.5 and less than 0.7.

D; Color gamut area ratio was less than 0.5.

(4) Transparency

The transparency of OHT images was evaluated by the following procedure. The spectral transmittance of visible light of the image was measured by an automatic spectrophotometer type 3030, manufactured by Hitachi Ltd., using a OHT sheet having no image to measure transmittance at 452 nm. The transmittance at 542 nm was used as the measure of the transparency of the OHT image. Higher value was corresponds to superior transparence it was judged that the image having a transmittance of not less than 65% had good transparency.

(5) Variation of Image Density Depending on Humidity-Lowering of Charging Amount Under HH—

Under each of a high-temperature and high-humidity condition (temperature: 33° C., relative humidity: 80%) and a low-temperature and low-humidity condition (temperature: 10° C., relative humidity; 9%), 20,000 sheets of copy were printed and the relative density of 10%-halftone pink color image of 20 mm×20 mm formed on the 20,000$^{th}$ print was measured by Macbeth reflection densitometer PD-918 and the difference of the image densities depending on the difference of the conditions. It was judged that the variation of image quality is small and suitable when the density variation was not more than 0.06. It was judged that the variation of the image quality is small and practically usable when the density variation was not less than 0.10.

TABLE 1

| | | Tone controlling agent | | | Colorant | Adding | Resin particle | | Evaluation result | | | | |
|---|---|---|---|---|---|---|---|---|---|---|---|---|---|
| No. | Toner | Compound | Peak of fluorescence spectrum (nm) | Colorant compound | fine particle dispersion No. | portion of tone controlling agent | Core | Shell | Sensual evaluation of bluish image | Sensual evaluation of reddish image | Color difference (Ratio) | Transparency (%) | Image density variation depending on humidity |
| Ex. 1 | M toner 1 | K-1 | 435 | Dye-5 | 4 | Core | LX-1 | None | A | A | 0.92 | 85 | 0.02 |
| Ex. 2 | M toner 2 | K-2 | 430 | Dye-5 | 4 | Core | LX-1 | None | A | A | 0.93 | 81 | 0.02 |
| Ex. 3 | M toner 3 | K-3 | 435 | Dye-5 | 4 | Core | LX-1 | None | A | A | 0.84 | 84 | 0.04 |
| Ex. 4 | M toner 4 | K-4 | 434 | Dye-5 | 4 | Core | LX-1 | None | A | A | 0.86 | 85 | 0.04 |
| Ex. 5 | M toner 5 | K-5 | 428 | Dye-5 | 4 | Core | LX-1 | None | B | A | 0.81 | 86 | 0.04 |
| Ex. 6 | M toner 6 | K-6 | 434 | Dye-5 | 4 | Core | LX-1 | None | B | A | 0.82 | 84 | 0.04 |
| Ex. 7 | M toner 7 | K-7 | 430 | Dye-5 | 4 | Core | LX-1 | None | A | A | 0.9 | 82 | 0.04 |
| Ex. 8 | M toner 8 | K-8 | 433 | Dye-5 | 4 | Core | LX-1 | None | A | A | 0.91 | 82 | 0.03 |
| Ex. 9 | M toner 9 | K-9 | 432 | Dye-5 | 4 | Core | LX-1 | None | B | A | 0.83 | 85 | 0.02 |
| Ex. 10 | M toner 10 | K-11 | 420 | Dye-5 | 4 | Core | LX-1 | None | B | A | 0.83 | 86 | 0.06 |
| Ex. 11 | M toner 11 | K-14 | 420 | Dye-5 | 4 | Core | LX-1 | None | B | A | 0.82 | 85 | 0.08 |
| Ex. 12 | M toner 12 | K-15 | 420 | Dye-5 | 4 | Core | LX-1 | None | A | A | 0.92 | 84 | 0.04 |
| Ex. 13 | M toner 13 | K-12 | 429 | Dye-5 | 4 | Core | LX-1 | None | B | A | 0.85 | 84 | 0.07 |
| Ex. 14 | M toner 14 | K-13 | 429 | Dye-5 | 4 | Core | LX-1 | None | B | A | 0.86 | 86 | 0.04 |
| Ex. 15 | M toner 15 | K-1 | 435 | D-3 | 3 | Core | LX-1 | None | A | A | 0.84 | 88 | 0.03 |
| Ex. 16 | M toner 16 | K-1 | 435 | P.R.48 | 5 | Core | LX-1 | None | B | B | 0.71 | 72 | 0.03 |
| Ex. 17 | M toner 17 | K-1 | 435 | P.R.81 | 6 | Core | LX-1 | None | B | B | 0.74 | 70 | 0.08 |
| Ex. 18 | M toner 18 | K-1 | 435 | P.R.122 | 7 | Core | LX-1 | None | B | B | 0.72 | 69 | 0.05 |
| Ex. 19 | M toner 19 | K-1 | 435 | P.R.185 | 8 | Core | LX-1 | None | B | B | 0.73 | 67 | 0.06 |
| Ex. 20 | M toner 20 | K-1 | 435 | D-1 | 1 | Core | LX-1 | None | A | A | 0.92 | 84 | 0.02 |
| Ex. 21 | M toner 21 | K-1 | 435 | D-3 | 3 | Shell | LX-1 | LX-2 | A | A | 0.93 | 85 | 0.02 |
| Ex. 22 | M toner 22 | K-2 | 430 | D-1 | 1 | Shell | LX-1 | LX-3 | A | A | 0.9 | 82 | 0.02 |
| Ex. 23 | M toner 23 | K-2 | 430 | D-3 | 3 | Shell | LX-1 | LX-3 | A | A | 0.92 | 85 | 0.02 |
| Ex. 24 | M toner 24 | K-1 | 435 | D-1 | 1 | Core | LX-2 | None | A | A | 0.9 | 81 | 0.04 |
| Comp. Ex. 1 | Comp. M toner 1 | None | None | P.R.122 | 7 | — | LX-1 | None | D | B | 0.48 | 68 | 0.54 |
| Comp. Ex. 2 | Comp. M toner 2 | None | None | D-1 | 1 | — | LX-1 | None | D | B | 0.64 | 85 | 0.11 |
| Comp. Ex. 3 | Comp. M toner 3 | None | None | D-2 | 2 | — | LX-1 | None | C | B | 0.68 | 84 | 0.18 |
| Comp. Ex. 4 | Comp. M toner 4 | None | None | Dye-5 | 4 | — | LX-1 | None | C | B | 0.51 | 82 | 0.21 |

Ex.: Example
Comp. Ex.: Comparative example
M toner: Magenta toner
Comp. M toner: Comparative magenta toner
P.R.48: C.I. Pigment Red 48,
P.R.81: C.I. Pigment Red 81,
P.R.122: C.I. Pigment Red 122,
P.R.185: C.I. Pigment Red 185

As above-mentioned, it is confirmed that excellent chromaticness and transparency can be obtained, high quality images can be certainly formed, large variation in the tone is not caused, extremely high light fastness can be obtained and high quality image can be maintained for prolonged duration by the developers 5 to 14 relating to Examples 1 to 10.

The invention claimed is:

1. A magenta toner for developing an electrostatic image comprising:

magenta color particles containing a binder, a magenta colorant, and a tone controlling agent having a peak of fluorescent spectrum within the range of from 380 to 500 nm and being a compound represented by Formula 2, Formula 2

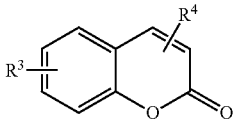

wherein, $R^3$ is a hydrogen atom or a mono-valent substituent, and $R^4$ is a hydrogen atom, an alkyl group, an alkoxy group or an aryl group.

2. The magenta toner of claim 1, wherein $R^3$ is a mono-valent substituent containing a nitrogen atom-containing heterocyclic ring.

3. The magenta toner of claim 2, wherein $R^3$ is a substituent containing a mono-valent triazine ring, triazole ring or pyrazole ring.

4. The magenta toner of claim 1, wherein an amount of the tone controlling agent is from 0.01 to 12% by weight of the magenta color particles.

5. The magenta toner of claim 4, wherein an amount of the tone controlling agent is from 1 to 8% by weight of the magenta color particles.

6. The magenta toner of claim 1, wherein the magenta colorant is an oil-soluble dye or a metal chalet dye.

7. The magenta toner of claim 1, wherein the oil soluble dye is a rhodamine compound.

8. The magenta toner of claim 1, wherein the magenta colorant is one selected from the group consisting of C. I. Pigment Reds 5, 48:1, 53:1, 57:1, 122, 139, 144, 149, 166, 177 and 222, and C. I. Pigment Oranges 31 and 43.

9. The magenta toner of claim 1, wherein the magenta color particles have a core/shell structure.

10. The magenta toner of claim 9, wherein the core contains a binder resin and a magenta colorant and the shell contains a resin covering the core and substantially no magenta colorant.

11. The magenta toner of claim 9, wherein the core contains the tone controlling agent.

12. The magenta toner of claim 9, wherein the shell contains the tone controlling agent.

13. The magenta toner of claim 1, wherein a particle diameter of the magenta color particles is from 4 to 10 μm in volume-based median diameter.

14. The magenta toner of claim 1, wherein the magenta color particles contain magenta colorant fine particles dispersed in the magenta color particles.

15. The magenta toner of claim 14, wherein a volume-based median diameter of the magenta colorant fine particles is from 10 to 500 nm.

16. The magenta toner of claim 1, wherein a hue angle of a visible image formed by the magenta image represented by a L*a*b* system of color representation is from 320° to 340°, wherein L* is brightness, a* is hue in the green-red direction and b* is hue in the yellow-blue direction.

* * * * *